US010533389B2

(12) United States Patent
Peveri

(10) Patent No.: US 10,533,389 B2
(45) Date of Patent: Jan. 14, 2020

(54) VALVE ASSEMBLY FOR DRILLING SYSTEMS

(71) Applicant: Schlumberger Technology Corporation, Sugar Land, TX (US)

(72) Inventor: Luigi Peveri, Florenzuola D'arda (IT)

(73) Assignee: Schlumberger Technology Corporation, Sugar Land, TX (US)

( * ) Notice: Subject to any disclaimer, the term of this patent is extended or adjusted under 35 U.S.C. 154(b) by 206 days.

(21) Appl. No.: 15/516,021

(22) PCT Filed: Oct. 1, 2015

(86) PCT No.: PCT/IB2015/001733
§ 371 (c)(1),
(2) Date: Mar. 31, 2017

(87) PCT Pub. No.: WO2016/051255
PCT Pub. Date: Apr. 7, 2016

(65) Prior Publication Data

US 2017/0247961 A1 Aug. 31, 2017

(30) Foreign Application Priority Data

Oct. 2, 2014 (IT) ..... MI2014A001725

(51) Int. Cl.
*E21B 21/10* (2006.01)
*E21B 19/02* (2006.01)
*E21B 34/00* (2006.01)

(52) U.S. Cl.
CPC ..... *E21B 21/106* (2013.01); *E21B 19/02* (2013.01); *E21B 34/00* (2013.01); *E21B 2034/005* (2013.01)

(58) Field of Classification Search
CPC ..... E21B 21/106
See application file for complete search history.

(56) References Cited

U.S. PATENT DOCUMENTS

2006/0278434 A1 12/2006 Calderoni
2011/0308860 A1 12/2011 Deboer

FOREIGN PATENT DOCUMENTS

WO 2008/095650 A1 8/2008
WO 2014/060759 A2 4/2014
WO 2015/033260 A2 3/2015

OTHER PUBLICATIONS

Examination Report for the equivalent UK patent application 1706388.4 dated Feb. 14, 2019.

*Primary Examiner* — Kristyn A Hall
(74) *Attorney, Agent, or Firm* — Jeffrey D. Frantz

(57) ABSTRACT

A valve assembly for drilling systems comprising a bidirectional valve (1) cooperating with a hydraulic clamping device (2) and being applied to a drilling machine for supplying a drilling fluid in two discrete directions, the valve assembly comprising a valve outer body adapted to be arranged between drilling rods while allowing said rod to be exchanged while keeping the mud continuously circulating.

20 Claims, 6 Drawing Sheets

VALVE ASSEMBLY FOR DRILLING SYSTEMS

BACKGROUND OF THE INVENTION

The present invention relates to a valve assembly for drilling systems.

As is known, drilling systems conventionally use perforated rods through which are pumped drilling fluids (drilling muds) adapted to properly control the ground hydrostatic properties and eject from the borehole the bit drilled debris while lubricating and reducing the drilling bit temperature to extend its lifetime and operating efficiency.

Prior drilling system further comprise a driving head and a hydraulic injector assembly for vertically and rotatively driving the drilling rods while pumping said drilling fluids therethrough.

Said prior drilling systems moreover also provide to shut-off the mud injection pumps upon having operatively driven a given drilling rod string, and as a novel drilling rod string must be connected to the driving head.

Conventionally, in this drilling rod withdrawing step, the mud injection pumps are switched off as the whole drilling rod string is withdrawn from the borehole and the string must be removed to recover the remaining rods still present in the borehole.

This operation is dangerous and complex since, as the pumps are switched off and the delivery of the drilling muds through the borehole is stopped, a borehole pressure surge due to a changing of the mud pressure from a dynamic to a static condition occurs, with a possible dangerous accidental and uncontrolled fracturing of the soil.

Moreover, as the mud flow is stopped, also the debris flow to the soil surface is stopped thereby said debris deposit on the borehole bottom, on the back of the drilling bit, thereby the drilling rod battery and related equipments are jammed at the borehole bottom because of the settled down debris.

Both the above situations must be absolutely prevented, because of economic and personnel and environmental safety reasons.

SUMMARY OF THE INVENTION

The aim of the present invention is to provide such a valve assembly adapted to overcome the prior art drawbacks.

Within the scope of the above mentioned aim, a main object of the invention is to provide such a valve assembly assuring an enhanced operating safety, while eliminating the need of stopping the mud flow through the well or borehole during the rod exchanging steps.

Another object of the present invention is to provide such a valve assembly for automatically opening/closing the two mud flowing paths without using dedicated actuating means, simply by a hydraulic clamping assembly.

Another object of the present invention is to provide such a valve assembly with very low operating costs, preventing the drilling rod battery from jamming in a rod changing operation, while increasing the safety and the drilling rate.

Yet another object of the invention is to provide such a valve assembly which is very reliable and safe in operation.

According to one aspect of the present invention, the above mentioned aim and objects, as well as yet other objects, which will become more apparent hereinafter, are achieved by a valve assembly for drilling systems, characterized in that said valve assembly comprises a bidirectional valve cooperating with a hydraulic clamping device and being applied to a drilling machine for supplying a drilling fluid in two discrete flow directions.

Said valve assembly comprises a valve device outer body adapted to be arranged between the drilling rods while allowing said rod to be easily exchanged while keeping the liquid or mud continuously circulating.

Said outer body comprises an axial valve set having a valve jacket for housing a closing axial clapet valve in a mud axial direction.

Said axial clapet valve, adapted to rotatively turn about an orthogonal pivot pin, remains at an open position under a gravity effect due to its weight as arranged in a vertical position and under the drilling fluid or mud centrifugal and hydrodynamic force even in a horizontal position thereof.

The jacket comprises a valve housing preventing said clapet valve from interfering against the borehole circulating fluid and/or instruments.

Upon reversing the mud flow, said valve is automatically closed, since it is hydrodynamically rotated and upward displaced from its housing thereby perfectly closing the jacket sealing seat.

Said outer body further comprises a second jacket member including two valves, an inner clapet valve and an outer sliding valve.

Said sliding valve operates as an hydraulic piston, the sliding movement occurring under a pressure difference between two chambers.

Specifically, the sliding movement causes a spring to be compressed, which, as the pressure resumes a like value at the two parts, resets said valve to a closing position.

This pressure difference condition between the two zones of the valve occurs only as hydraulic clamping means are applied on the valve body.

In all the other cases, the areas thereon the pressure outside of the body is applied will aid a closing of said valve, since the area pressed by said spring is much larger than that facing the side pressure inlet.

Said hydraulic clamping means are operated as the valve is applied to the rod at a probing plane zone of the oil drilling system.

Thus, as said clamp or clamping means are applied, the fluid introducing duct will be radially pressurized.

In this way a differential pressure will occur on the valve body.

Accordingly, the sliding valve will be displaced to communicate the hydraulic clamp inner chamber with the valve radial opening.

Thus the clapet valve inner and outer pressures will be balanced to allow the side radially entering fluid to freely flow.

Thus, while the radially delivered fluid freely flows, the axially delivered fluid may be stopped thereby reversing for a short time the flow direction to allow the axial clapet valve to shut off the fluid in the respective direction as desired.

In this situation, it is possible to stop the fluid above the axial valve and deliver the fluid from the side inlet.

At the end of the new rod string introducing step, during the drilling operation, or in the withdrawn rod string disconnection operation and consequent reconnection to the driving head, in the rod withdrawing step, it is possible to start again the mud circulation in an axial direction.

Thus the radial clapet valve resumes under gravity its closing position.

At this time it is possible to discharge the pressure from the hydraulic clamp inner chamber thereby making the pressure outside the valve equal to the environment pressure.

In such a condition, the radial clapet valve will have an inner pressure higher than the outer one and, accordingly, said clapet valve will be pushed into its seat to provide a hydraulic sealing.

Upon closing the radial clapet valve, the sliding valve will be pushed by the spring into its seat thereby ejecting the fluid which, during the sliding, will have saturated any gap between the outer body and the sliding valve.

On the back of the sliding valve an air pocket is provided, preventing vacuum from forming and also contributing to cause the sliding valve to return into its seat.

Moreover, it is also possible to supply a portion of a lubricating material to prevent any possible jamming of the mutually sliding surfaces.

BRIEF DESCRIPTION OF THE DRAWINGS

Further characteristics and advantages of the present invention will become more apparent hereinafter from the following disclosure of a preferred, though not exclusive, embodiment of the invention which is illustrated, by way of an indicative but not limitative example, in the accompanying drawings, where.

DESCRIPTION OF THE PREFERRED EMBODIMENTS

Figure 1:
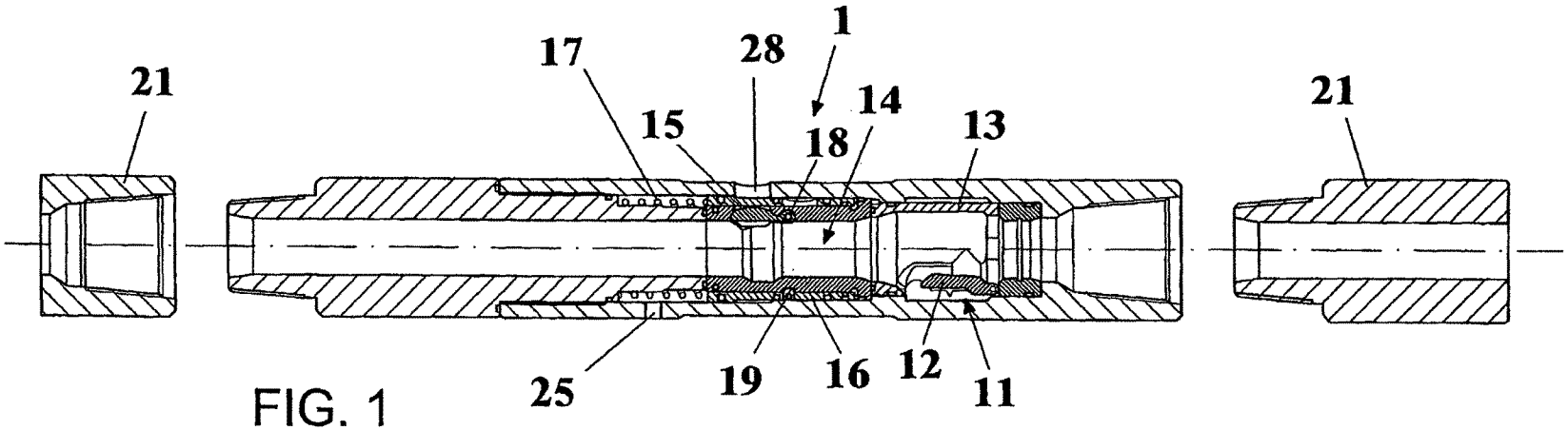
FIG. 1 is a cross-sectional view of the bidirectional valve according to the present invention, showing the outer size of the inventive valve assembly and its easy assembling between the drilling rods.
Figure 2:
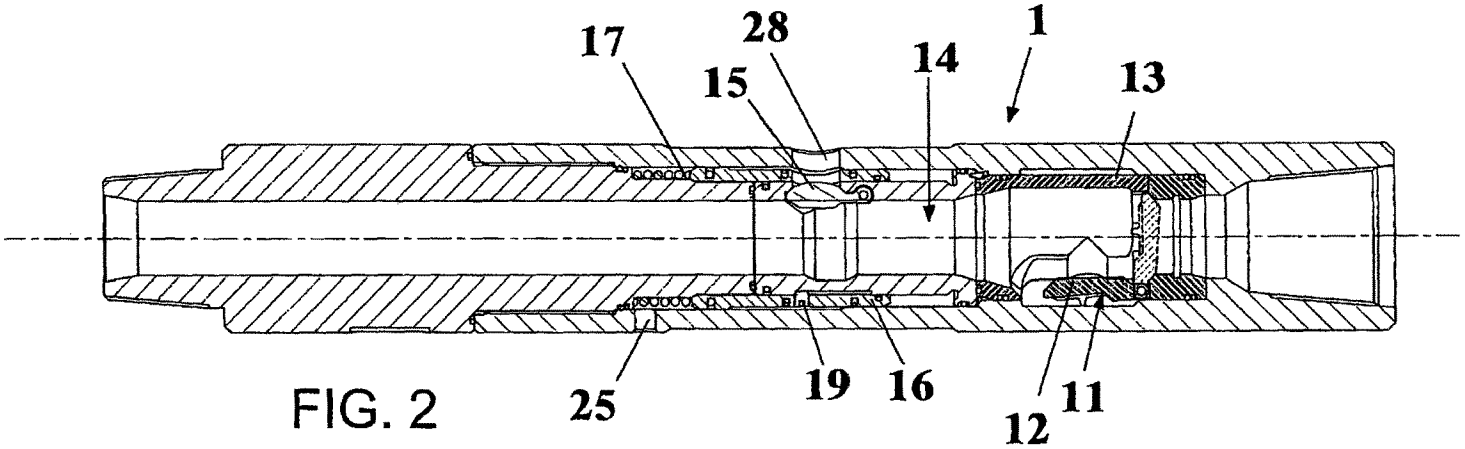
FIG. 2 is a view similar to the preceding one, showing the component set or assembly of the axial clapet valve.
Figure 4:
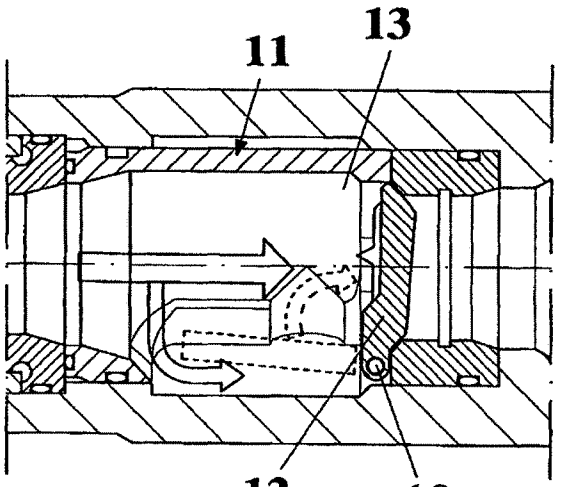
FIG. 4 is a view similar to the preceding one, showing the axial clapet valve in a closing step, upon a reversing of the drilling fluid direction.
Figure 3:
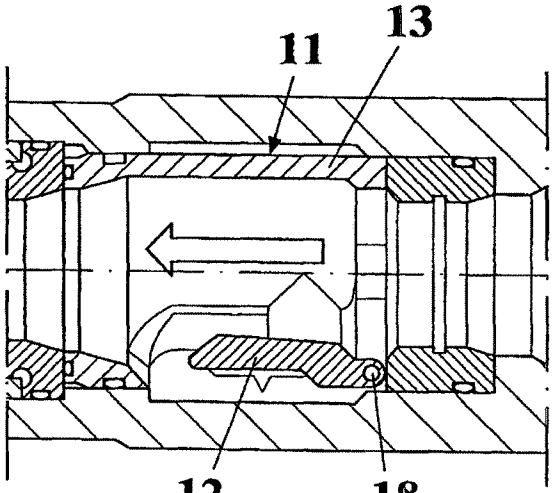
FIG. 3 is a detail cross-sectioned view of the component set of the axial valve, further showing the arrangement of the axial clapet valve during a passage of the fluid or mud in an axial direction.
Figure 5:
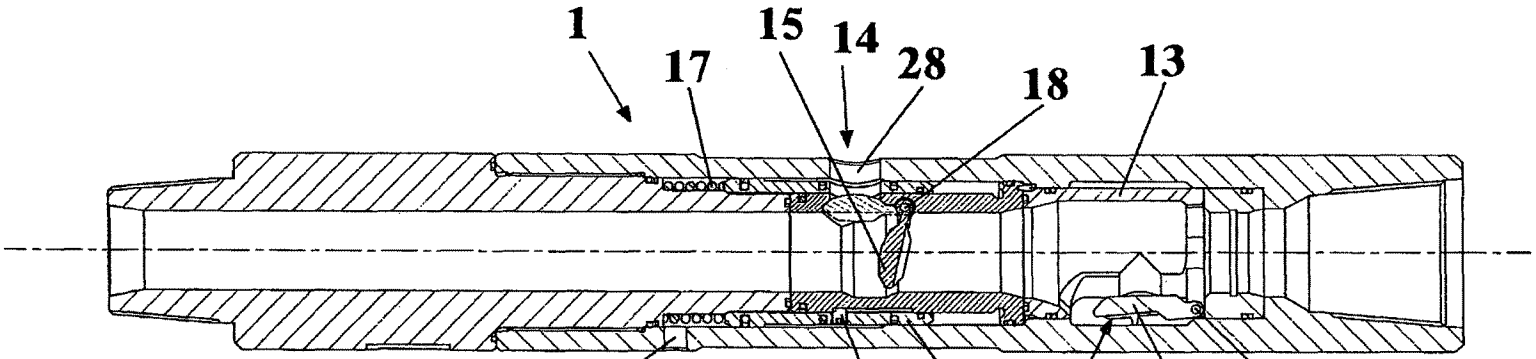
FIG. 5 is a longitudinal cross-section view of the valve assembly, showing the set of components of the radial clapet and sliding valves.
Figure 6:
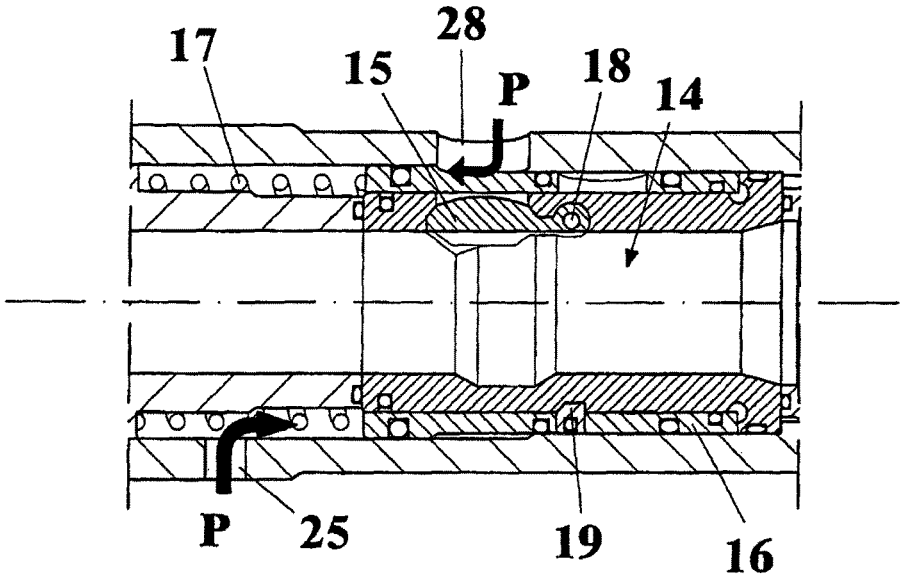
FIG. 6 is a detail view showing the areas facing the outside pressure, therefrom it should be apparent that the bottom area, much larger than the top area, facilitates a sliding in a closing direction.
Figure 7:
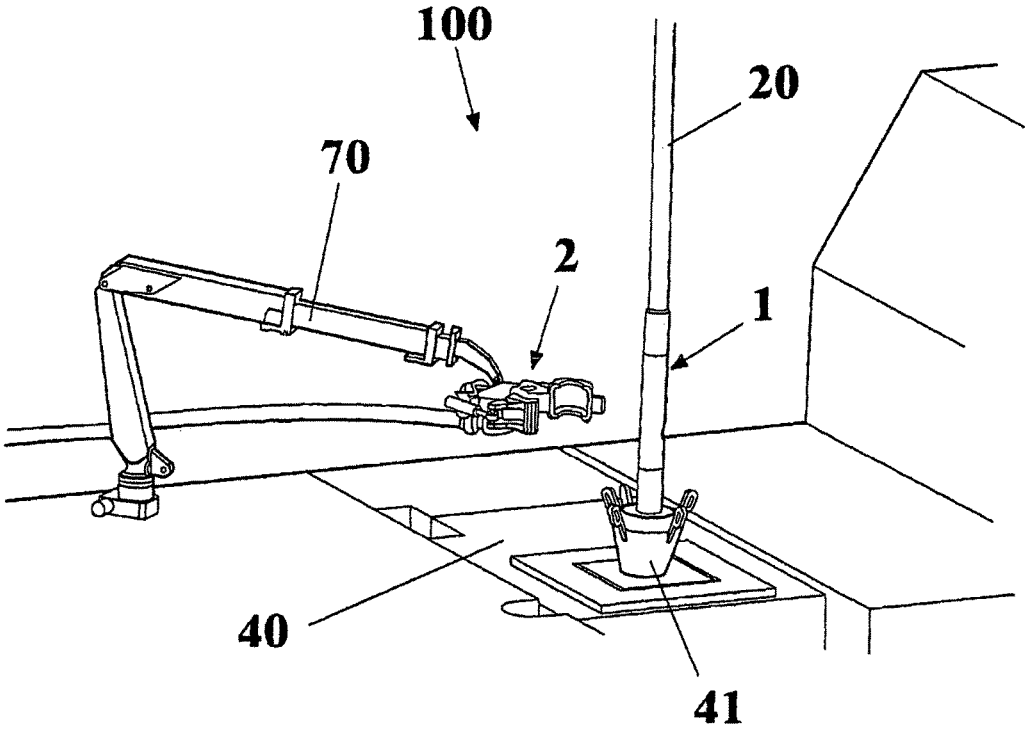
FIG. 7 is a perspective view of the probing plane of a drilling system, therefrom it is possible to see the installation of the bidirectional valve according to the invention at a vertical position between the drilling rods and the arrangement of the hydraulic clamp for operating the bidirectional valve.
Figure 8:
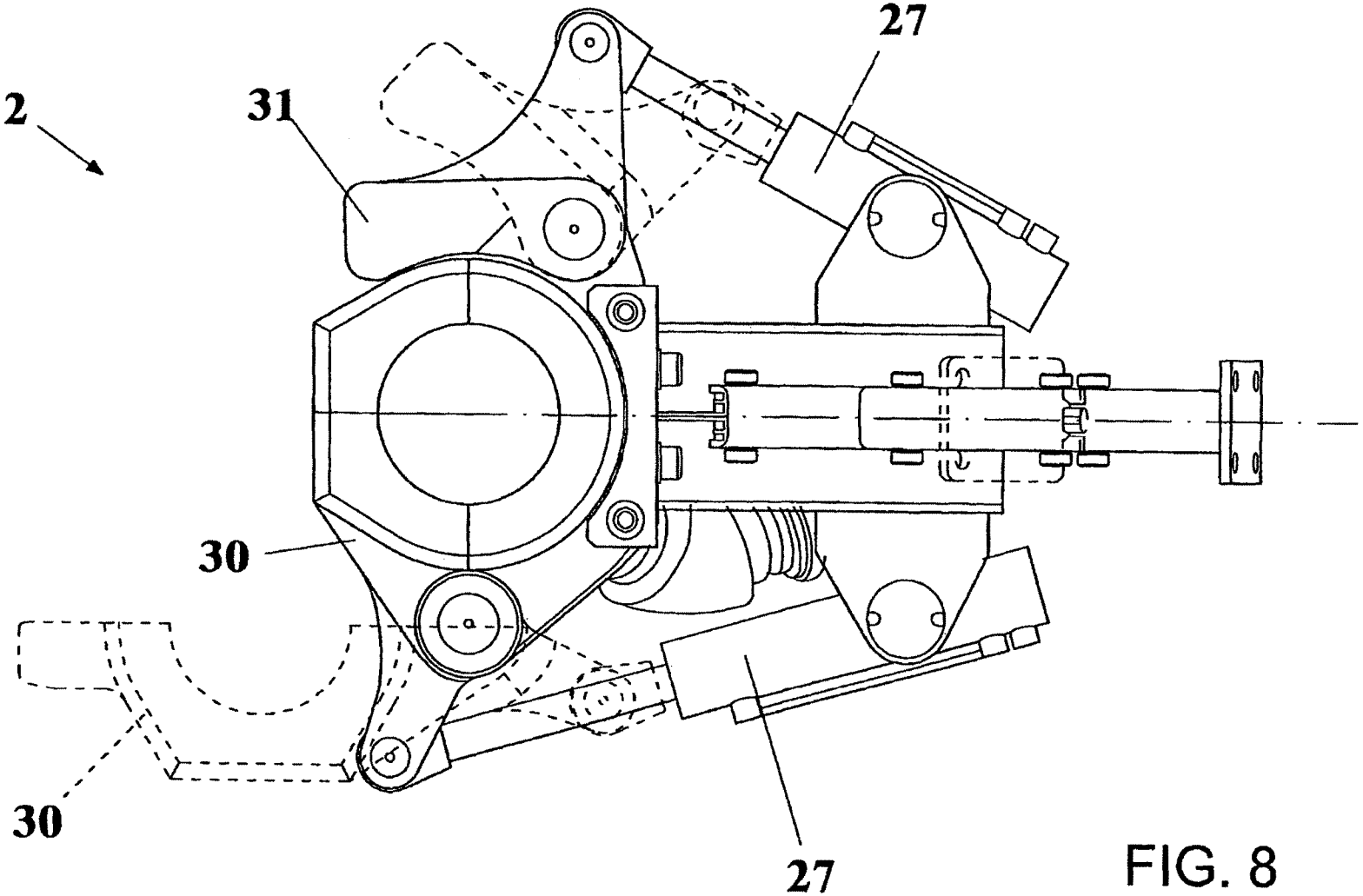
FIG. 8 is a top plan view of the hydraulic clamp or clamping assembly, clearly showing the opening, closing and turning movements on a horizontal axis.
Figure 9:
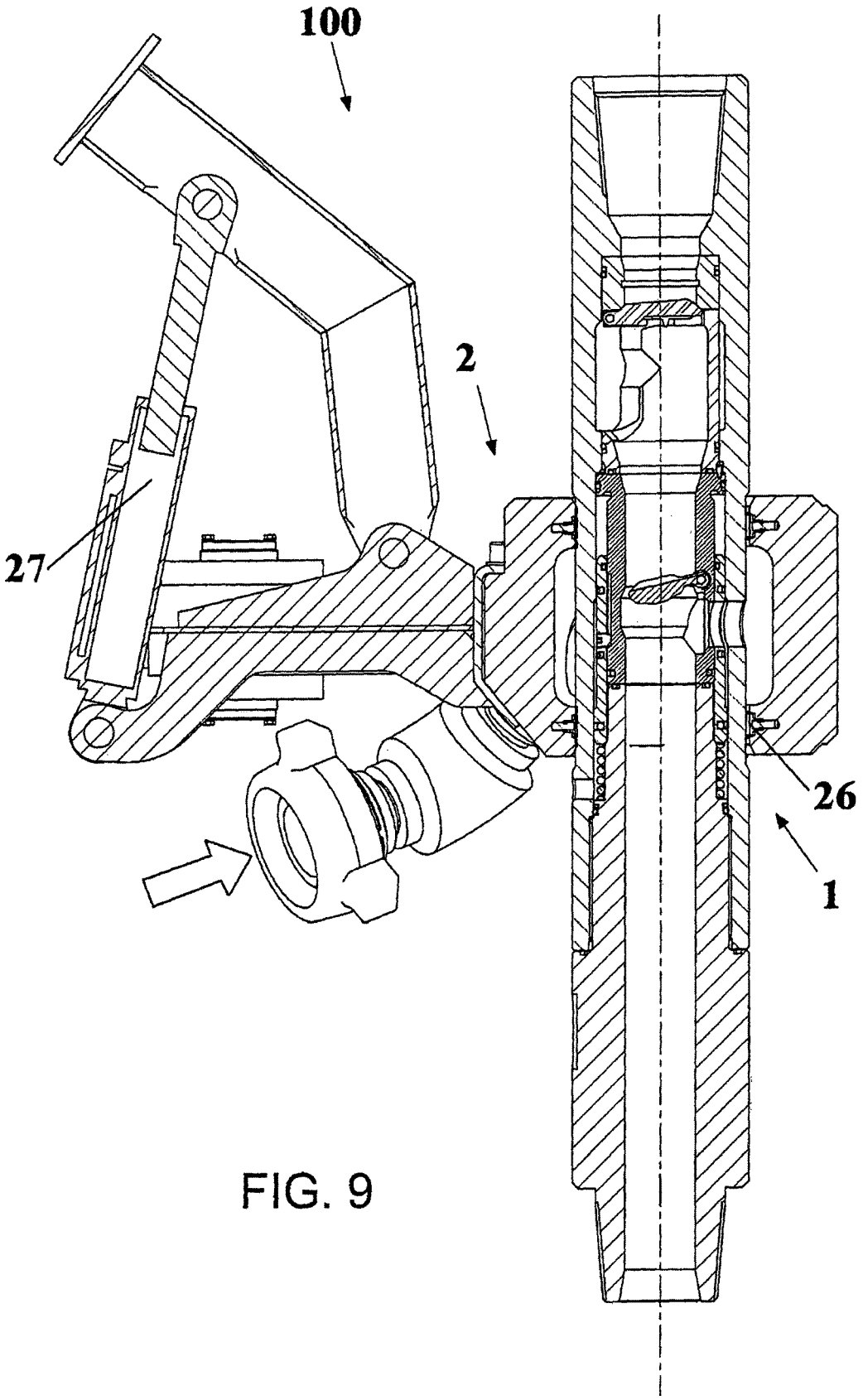
FIG. 9 is a longitudinal cross-sectional view showing the side fluid inlet channel and different pressure zones affecting the sliding valve.
Figure 10:
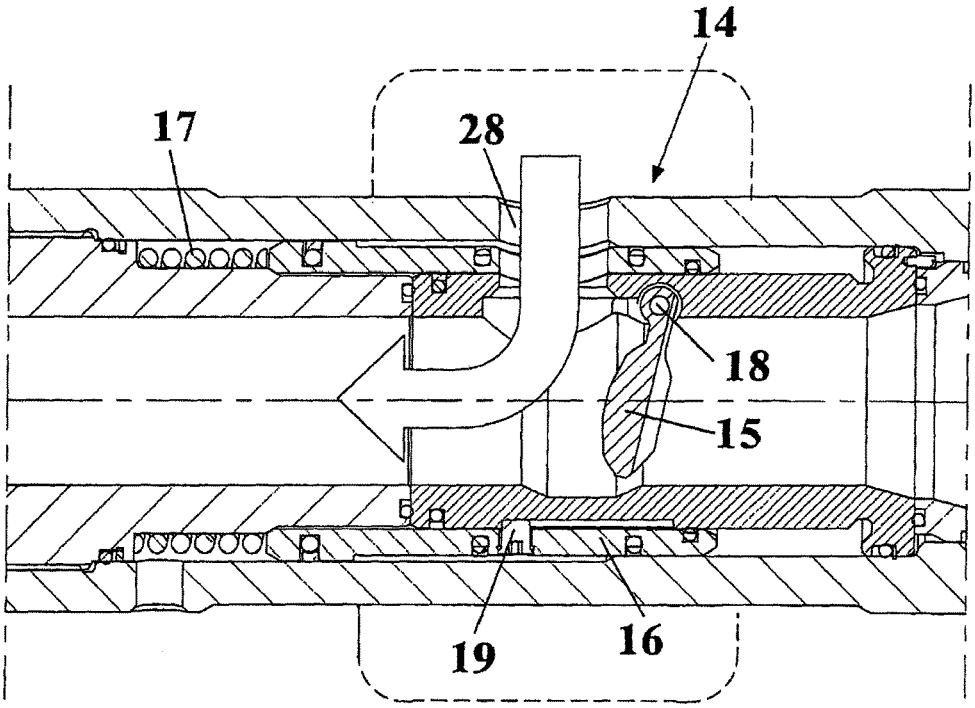
FIG. 10 is a cross-sectional view of the component set of the radial valve, wherein the radial clapet valve is urged to an opening position by the inlet fluid from the radial channel through the hydraulic clamp.
Figure 11:
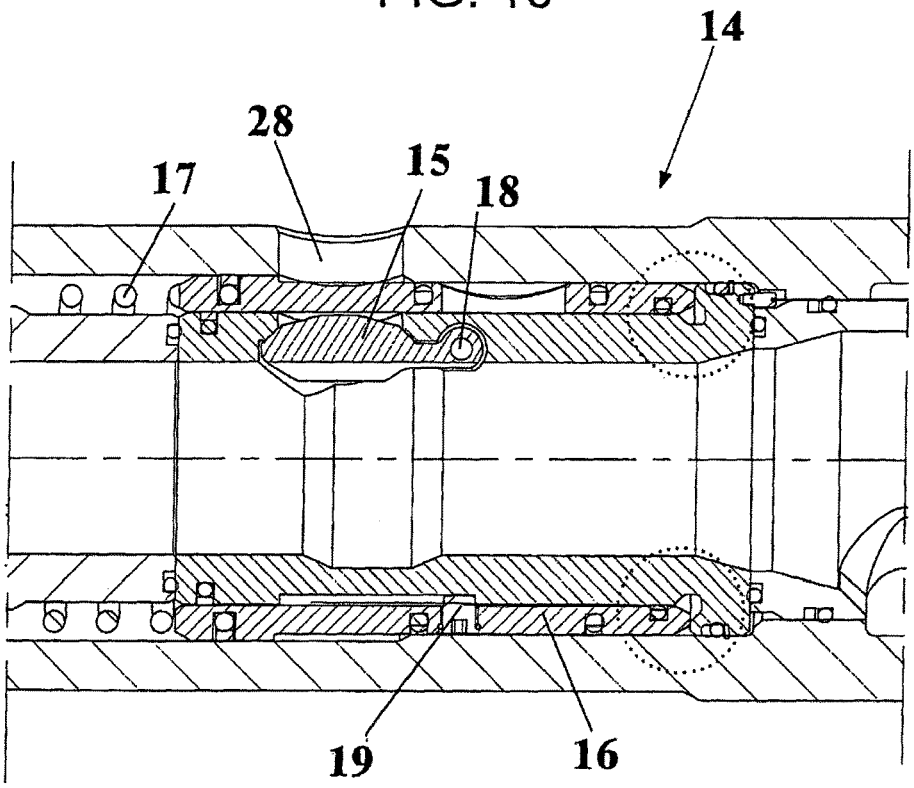
FIG. 11 is a detail cross-sectional view of the radial valve component set, clearly showing the air chamber preventing vacuum from forming during a sliding of the radial valve.

With reference to the number references of the above mentioned figures, the valve assembly, specifically designed for drilling systems, according to the present invention, and which has been generally indicated by the reference number 100, substantially comprises a bidirectional valve device 1 cooperating with a hydraulic clamp or clamping device 2, being applied to a per se known drilling machine.

The bidirectional valve device 1 allows the drilling fluid to be circulated in two directions, i.e. an axial direction with the device being arranged in a drilling/withdrawing condition, and a radial direction when a rod is changed and it is necessary to disconnect the mud or fluid circuit in a valve axial direction, respectively.

The bidirectional valve element 1 comprises an outer body adapted to be connected to conventional drilling rods 20, an axial valve set 11 and a radial valve set 14.

The axial valve set 11 comprises an axial clapet valve 12, adapted to turn on an orthogonal pivot pin 18, and an axial jacket 13.

Said axial jacket 13 comprises an housing in which, in an opening position, the clapet valve is arranged thereby it does not interfere against the circulating fluid and/or instruments necessary for the well operation, and a sealing seat where the valve is closed during a fluid circulation from the radial valve.

The radial valve set 14 comprises an outer sliding valve 16 and a radial clapet valve 15, adapted to turn about orthogonal pivot pin 18.

The sliding valve 16 is driven by a pressure difference between two pressure inlet points to the outside, the bottom pressure inlet point 25 and the radial fluid inlet channel 28.

The pressure applied to said two points must be higher than the load that the spring 17 can resist against, thereby causing the spring to be compressed and the two fluid passage ports to be precisely arranged facing one another.

A dowel 19 is slidably engaged in a seat formed on the radial valve jacket, thereby providing a precisely guided sliding movement while preventing the two fluid passage holes or ports from being misaligned from one another.

Said seat has a size adapted to cause the sliding movement to occur in a given direction and with a given stroke.

The pressure difference is so designed based on the mechanical characteristics of the spring 17 and it must always sufficient to assure a full opening of the sliding valve 16, that is up to the end of stroke position of the dowel 19.

The radial clapet valve 15 remains in a closed position as the inner pressure and the fluid passage in an axial direction hold said valve in its seat.

Said valve is opened as the outer pressure is equal or higher than the inner pressure.

The sliding valve is opened only and exclusively when a pressure difference occurs between the two above inlet points and never under different conditions.

In fact, it is possible that in the gap between the well and rod a higher pressure occurs, and, accordingly, if a valve additional to the radial clapet valve were not provided, then said radial clapet valve would be opened in such conditions with the problems related to a situation of perforated rod.

On the contrary, by the sliding valve thus designed, such a possibility is prevented from occurring, and by a proper designing of the arrangement of the gaskets, even in a case of a leakage of the radial clapet valve, the drilling fluid would be prevented from leaking from inside to outside.

The bidirectional valve 1 comprises a recess on its outer body for housing the hydraulic clamp or clamping means 2 which are coupled through two gaskets 26 providing a hydraulic sealing on the valve outer body.

Said recess is so designed as to allow the clamping means to be closed only in a given position, thereby preventing the bottom pressure inlet 25 and radial fluid inlet channel 28 from being communicated.

Moreover, said recess does not allow the clamping means to be so applied as to cause the gasket to be overlapped on the radial outlet, thereby causing a pumping of the fluid outside the clamping means.

The movable shell of the clamp or clamping means 30 and the closing hook element 31 of the clamp are urged by two urging cylinders thereby perfectly closing about the recess of the bidirectional valve 1.

The hydraulic clamping means 2 are so designed as to provide a full chamber about the whole valve, for freeing the radial fluid inlet channel 28 direction.

The hydraulic clamp or clamping means 2 allow moreover the rod to be rotatively driven, while keeping the system safe and preventing the mud connection duct from being accidentally rotated at a high speed, during the rod screwing on or off operations, upon disengaging it from the system wedge elements 41.

The bidirectional valve device 1 according to the present invention operates as follows.

At first, a plurality of bidirectional valves are preassembled on the head of the drilling rod strings.

Then, the drilling strings are connected by screwing to the top drive and introduced into the well or borehole to perform the drilling operation.

Upon having drilled a drilling distance required for arriving with the bidirectional valve at the probe plane 40, the wedge elements 41 allowing to support the drilling battery introduced into well are engaged.

The hydraulic clamp or clamping means are then brought to their designed position by the clamp support 70 and the closing or closure cylinders 27 are hydraulically driven.

The fluid inlet tube or duct 21 is filled-in and pressurized, thereby inside the clamp a condition for opening the sliding valve 16 will be established.

The fluid is pumped with a pressure equal to the inner pressure of the bidirectional valve, thereby causing the radial clapet valve to be disengaged from its seat.

At this time the fluid in the axial direction is stopped and for a time the fluid supplied by the radial fluid inlet channel will be partially directed to the bottom of the well and partially toward the axial valve.

That portion of the fluid moving upward in the direction of the axial valve allows the clapet valve to disengage from its housing and to engage in its sealing seat thereby closing the fluid axial inlet path.

At this time, it is possible to disconnect the top drive, in the drilling operation, or the rods 20, in the withdrawing operation, thereby preventing the pump system from being switched off, and allowing the drilling operation with a safety mud circulation.

Upon connecting a new rod string and related bidirectional valve on the string head, during the drilling operation, or directly the top drive on the valve, during the withdrawing operation, the muds will be again pumped in an axial direction.

Thus, since the axial clapet valve is subjected to a like pressure, it will turn and will be relocated in the axial jacket housing.

The radially pumped fluid is stopped to cause the radial claped valve to turn in its sealing seat.

The fluid in the clamping means is discharged thereby causing the outer pressure to achieve the environment pressure.

Upon discharging or unloading, the sliding valve will be urged by the spring to the closing position.

Then, the drilling or withdrawing operations may be continued by the known methods.

It has been found that the invention fully achieves the intended aim and objects.

In fact, a very safe valve assembly with related bidirectional valve device has been provided, since it prevents a stopping of the drilling fluid or mud through a well, while keeping unaltered the drilling conditions.

The subject device, moreover, allows a quick resumption of the drilling operation, owing to the automatically operating components thereof.

Moreover, the device assures an efficient fluid feeding to the well in all drilling operations.

In practicing the invention, the used materials, as well as the contingent size and shapes, can be any according to requirements.

The invention claimed is:

1. A system comprising:

a valve having a longitudinal bore extending from a first end to an opposite second end and configured for passing drilling fluid therethrough, the valve having an axial port extending into an interior of the valve, the valve further comprising:

a sliding sleeve movable from a closed position to an open position, wherein the sliding sleeve provides access to the interior of the valve if the sliding sleeve is located in the open position, a pivotable member positioned between the interior of the valve and the sliding sleeve, wherein the pivotable member is movable from a first position to a second position, and further wherein the pivotable member located at the first position and the sliding sleeve located at the closed position prevent access to the interior of the valve, and a pivotable valve positioned adjacent to the first end or the opposite second end and movable from an open position to a closed position, wherein the pivotable valve provides access to the longitudinal bore if the pivotable valve is located in the open position, wherein the sliding sleeve is biased in the closed position, the pivotable member is biased in the first position and the pivotable valve is biased in the open position.

2. The system of claim 1, wherein the sliding sleeve is configured to be moveable from the closed position to the open position without moving the pivotable member.

3. The system of claim 2, wherein a predetermined amount of drilling fluid pressure applied to the axial port causes the sliding sleeve to move to the open position.

4. The system of claim 1, wherein the sliding sleeve is configured to be moveable independent from the pivotable member.

5. The system of claim 1, further comprising:

a clamp with a circumferential fluid chamber extending around the circumference of the valve at the axial port, wherein the sliding sleeve is configured to move from the closed position to the open position when drilling fluid is provided to the circumferential fluid chamber of the clamp extending around the circumference of the valve at the axial port.

6. The system of claim 5, wherein the clamp comprises two half shell portions that are movable and closable around the valve adjacent to the axial port.

7. The system of claim 5, wherein the pivotable member is configured to be movable from a longitudinal position preventing access to the axial port to a radial position in response to a predetermined amount of pressure from the drilling fluid provided to the circumferential fluid chamber of the clamp if the sliding sleeve is located in the open position.

8. The system of claim 5, wherein a first portion of the circumferential fluid chamber overlaps the axial port of the valve such that drilling fluid pressure is applied to the axial port when drilling fluid is provided to a second portion of the circumferential fluid chamber adjacent to the first portion of the circumferential fluid chamber.

9. The system of claim 5, wherein the valve has an outer body comprising a recess configured to house the clamp such that the axial port of the valve is positioned within the circumferential fluid chamber of the clamp.

10. The system of claim 9, further comprising:

a hydraulic sealing between the circumferential fluid chamber of the clamp and the outer body of the valve provided by gaskets coupling the clamp and the outer body of the valve together.

11. The system of claim 1, wherein a drilling fluid passage through the longitudinal bore from the first end to the opposite second end is restricted or prevented when at least one of:

the pivotable valve is located in the closed position; and the pivotable member is located in the second position.

12. The system of claim 1, wherein a drilling fluid passage is provided through the axial port of the valve bypassing the pivotable valve when the sliding sleeve is located in the open position and the pivotable member is located in the second position.

13. A method comprising:

providing a valve having a longitudinal bore extending from a first end to an opposite second end and an axial port extending into an interior of the valve, the valve further comprising a sliding sleeve that is closed preventing access to the interior of the valve and a pivotable member positioned between the interior of the valve and the sliding sleeve, wherein the pivotable member is closed preventing access to the interior of the valve;

opening the sliding sleeve of the valve by applying a drilling fluid pressure to the axial port; and opening the pivotable member of the valve by applying a subsequent drilling fluid pressure to the axial port, wherein access through the axial port to the interior of the valve is provided when both the sliding sleeve and the pivotable member are open and further wherein the sliding sleeve moves independent from the pivotable member.

14. The method of claim 13, further comprising:

extending a circumferential fluid chamber around the circumference of the valve at the axial port such that a portion of the circumferential fluid chamber overlaps the axial port of the valve.

15. The method of claim 14, further comprising:

providing drilling fluid to the circumferential fluid chamber such that at least one drilling fluid pressure is applied, by the portion of the circumferential fluid chamber, to the axial port by the provided drilling fluid in the circumferential fluid chamber.

16. The method of claim 15, wherein the at least one drilling fluid pressure applied, by the portion of the circumferential fluid chamber, to the axial port opens at least one selected from the sliding sleeve and the pivotable member.

17. The method of claim 13, further comprising:

closing a pivotable valve positioned adjacent to the first end or the opposite second end to prevent passage of drilling fluid through the longitudinal bore from the first end to the opposite second end.

18. The method of claim 13, wherein each of the pivotable valve, the sliding sleeve and the pivotable member move independently with respect to each other, and further wherein the sliding sleeve is biased in the closed position, the pivotable member is biased in the first position and the pivotable valve is biased in the open position.

19. A system comprising:

a valve having a longitudinal bore extending from a first end to an opposite second end and configured for passing drilling fluid therethrough, the valve having an axial port extending into an interior of the valve, the valve further comprising:

a sliding sleeve movable from a closed position to an open position, wherein the sliding sleeve provides access to the interior of the valve if the sliding sleeve is located in the open position, a pivotable member positioned between the interior of the valve and the sliding sleeve, wherein the pivotable member is movable from a first position to a second position, and further wherein the pivotable member located at the first position and the sliding sleeve located at the closed position prevent access to the interior of the valve, and a clamp with a circumferential fluid chamber extending around the circumference of the valve at the axial port, wherein the sliding sleeve is configured to move from the closed position to the open position when drilling fluid is provided to the circumferential fluid chamber of the clamp extending around the circumference of the valve at the axial port, wherein the pivotable member is configured to be movable from a longitudinal position preventing access to the axial port to a radial position in response to a predetermined amount of pressure from the drilling fluid provided to the circumferential fluid chamber of the clamp if the sliding sleeve is located in the open position.

20. The system of claim 19, wherein the clamp comprises two half shell portions that are movable and closable around the valve adjacent to the axial port.

* * * * *